US005214442A

United States Patent [19]

Roller

[11] Patent Number: 5,214,442

[45] Date of Patent: May 25, 1993

[54] ADAPTIVE DRYER CONTROL FOR INK JET PROCESSORS

[75] Inventor: George Roller, Penfield, N.Y.

[73] Assignee: Xerox Corporation, Stamford, Conn.

[21] Appl. No.: 766,243

[22] Filed: Sep. 27, 1991

[51] Int. Cl.[5] ..... B41J 2/21

[52] U.S. Cl. ..... 346/1.1; 101/424.1; 101/488; 219/216; 346/25; 346/140 R

[58] Field of Search ..... 346/1.1, 25, 140 R; 219/216; 101/424.1, 488; 34/56, 52, 48

[56] References Cited

U.S. PATENT DOCUMENTS

| | | | |
|---|---|---|---|
| 3,588,445 | 6/1971 | Hopkins | 219/216 X |
| 4,033,263 | 7/1977 | Richmond | 101/424.1 |
| 4,469,026 | 9/1984 | Irwin | 346/25 X |
| 4,549,803 | 10/1985 | Ohno | 219/216 X |
| 4,566,014 | 1/1986 | Paranjpe | 346/25 X |
| 4,634,262 | 1/1987 | Imaizumi et al. | 355/14 |
| 4,719,489 | 1/1988 | Ohkubo et al. | 219/216 X |
| 4,970,528 | 11/1990 | Beaufort et al. | 346/25 |
| 5,021,805 | 6/1991 | Imaizumi | 346/25 X |

OTHER PUBLICATIONS

Ayash et al; "Ink Jet Dryer with Individually Actuable Elements", Xerox Disclosure Journal, V7, N5, Sep./Oct. 1982, pp. 317-318.

*Primary Examiner*—Joseph W. Hartary
*Attorney, Agent, or Firm*—Oliff & Berridge

[57] ABSTRACT

An adaptive dryer for a printing system obtains values representing mass of ink and/or area coverage of ink on each page to be printed prior to drying and based on the determined mass-area coverage varies one or both of feed rate of the pages through the dryer and temperature of the dryer to more closely adapt the drying parameters of the dryer with the particular drying criterion each page requires for optimal quality, highest average throughput and minimal heating power requirements.

22 Claims, 5 Drawing Sheets

ADAPTIVE DRYER CONTROL FOR INK JET PROCESSORS

BACKGROUND OF THE INVENTION

1. Field of the Invention

The present invention relates to an adaptive dryer method and apparatus for controlling drying of printed pages of a printer based on determined mass-area coverage of ink on the pages. More specifically, the present invention relates to an adaptive dryer which, based on the determined mass-area coverage, varies one or both of feed rate of the pages through the dryer and temperature of the dryer.

2. Description of Related Art

Most printers utilize one of two methods of image fixing, either naturally air drying the image or routing the image to a heating unit for standard drying of the image. A common problem with air drying is an excessive amount of time, upwards of 30 seconds per page, which is needed to provide adequate drying. Drying with a heating unit to aid in fixing of the image requires the heating unit with sufficient power capacity to fix all or most images presented. A heating unit of this type utilizes an excess amount of power and additionally requires increased maintenance costs. The heating requirements for some pages of relatively low area coverage or low mass coverage are minimal and can result in excess energy being applied or excess time being spent drying an image which does not require the preset amount of heating. In addition, heating of pages beyond that necessary may result in overdrying which can distort, warp or otherwise deteriorate the appearance of the page. For example, drying parameters (such as temperature and/or feed rate) are set on a worst case condition for a 50% mass-area coverage image, when most sheets have a 6% mass-area coverage image, thus overdrying the sheets having 6% mass-area coverage image. Further, on some machines, the preset drying settings could cause unnecessary reduction in throughput by utilizing a feed rate of printed pages through the heating unit which is unduly slow due to a preset speed which is determined for a worst case scenario of image fixing requirements. The following are known patents which attempt to address certain problems of these first two types:

U.S. Pat. No. 4,719,489 to Ohkubo et al. discloses a recording apparatus having material dependent fixing control which controls a fixing means of the recording apparatus between first and second conditions dependent upon sensed feed modes. The sensed feed modes relate to papers of different thicknesses. In particular, the apparatus controls fixing temperature, pressure or feed rate therethrough based on detected paper thickness.

U.S. Pat. No. 4,634,262 to Imaizumi et al. discloses a toner image fixing control process and apparatus for an electrostatic copying machine. The apparatus includes a fixing station which normally operates at a fast speed when used for thin sheets, but will slow down when a thick sheet is detected in order to allow for extra time for a toner image on the thick sheet to fuse.

U.S. Pat. No. 3,588,445 to Hopkins discloses a fuser control circuit wherein the amount of power supplied to a fuser is proportional to the speed of paper upon which an image is being fixed. The speed is detected by detecting the width of input signal pulses.

U.S. Pat. No. 4,970,528 to Beaufort et al. discloses a method of uniformly drying ink on paper from an ink jet printer wherein a sheet is transported along a semicircular paper path such that an infrared bulb situated at the axis of symmetry of the semicircular path provides even heating to the entire sheet.

None of these references provides a dryer which closely matches the dryer operating parameters to a particular page's drying requirements based on the area of ink or mass of ink which covers the page.

OBJECTS AND SUMMARY OF THE INVENTION

It is an object of the present invention to provide an adaptive dryer which can minimize heating power requirements of a printer by determining a mass-area coverage of ink on a page prior to drying, the mass-area coverage being used to set either the fixing temperature of the dryer and/or the feed rate of the page through the dryer.

It is another object of the present invention to provide a method of determining mass-area coverage of ink on a page and using this information to control drying parameters to reduce unnecessary power usage of a dryer by controlling the amount of heat needed to properly fix the ink onto the page and/or controlling the feed rate at which the page is being transported past the dryer.

It is another object of the present invention to provide an ink jet printer which can determine mass-area coverage of ink on a page by examining on a page by page basis a bit stream decomposed from a page description language to infer ink mass-area coverage and controlling drying parameters based on the coverage.

The present invention is usable in a workstation environment in which documents are scanned, stored or created using a workstation personal computer system which converts an image or text into a digital representation. The digital representation may be in the form of a page description language (PDL) which can be sent to a decomposer which generates a bit stream of data to an output station. The output station may include a control means fixed in hardware or software which can analyze bits of information assigned in the bit stream to each page to make a determination as to the complexity and ultimately a predicted mass-area coverage of ink on each page. This provides information useful in determining of control parameters for drying of the page.

The mass-area coverage information may be used to control one or both of a fixing temperature and a transport speed at which documents having an unfixed image are passed through a dryer of the output station. Both of these are variables which control the amount of drying that is achieved on each page as it passes the dryer. By determining the mass of ink and area of ink coverage on the page prior to drying, the present invention is capable of reducing power requirements of prior systems (which designed heating power requirements for a worst case scenario of ink to dry) and can either increase the power output of the dryer if a certain threshold value of mass-area coverage is determined (maintaining a constant throughput) or may keep the power requirements at a preset value and decrease transport speed of the page past the dryer which allows for more drying due to a longer dwell time of the page in the dryer. The latter will reduce throughput, but is acceptable in all but the highest of throughput needs since the costs of machine operation can be kept at a lower value by not increasing power requirements of the dryer.

Preferably, various threshold values are included in the control means or a look-up table can be used to select proper dryer parameters based on the determined mass-area coverage. The larger the number of thresholds, the greater the matching of drying parameters of the system with the actual drying needs of each page. Such examples of drying control are more closely related to actual drying requirements of each page than prior systems. Numerous variables ultimately effect the drying requirements of a page such as area coverage of ink, the mass of ink applied, the thickness of the paper, the composition of the paper, ink composition, and environmental conditions like temperature and humidity. Of these, the most predominant variables are the area coverage of ink and the mass of ink applied. The mass or area coverage of ink are also the variables which can vary by the largest value. Numerous other values can be negated as near constants when designing heating requirements.

The present invention is applicable to any type of dryer commonly found on printers. The most common types are convective, radiant or microwave dryers. Convective dryers can use air flow, air temperature or paper velocity past the dryer as control parameters. Radiant and microwave dryers can similarly have control parameters such as power or temperature control or paper velocity past the dryers. Each particular dryer design would require specific feedback control based on the individual characteristics of the particular dryer being used.

BRIEF DESCRIPTION OF THE DRAWINGS

The invention will be described in detail with reference to the following drawings wherein.

DETAILED DESCRIPTION OF THE PREFERRED EMBODIMENTS

The invention will be described with reference to the term "mass-area coverage". The term "mass-area coverage" defines the area coverage of ink applied to a sheet and the mass of ink applied to a sheet. For example, in a single color system, two drops of ink placed adjacent each other have twice the area coverage but the same mass as two drops of ink placed one on top of the other. Further, many systems create various colors in the color gamut by overlaying one primary color on another. If a cyan, magenta and yellow system is employed to create a black color, the system would (simplistically) put one drop each of cyan, magenta and yellow on top of each other. The area of coverage would be a given value but the mass of ink coverage would be triple that of a single color. The term "mass-area coverage" will designate the mass of ink and the area of ink coverage, because drying relates to both the mass of the ink and area coverage of the ink.

Further, the invention will be described with reference to the term "fixing temperature", which defines the temperature that the dryer uses to fix the image. Since the invention is applicable to various types of dryers, the fixing temperature can represent, for example, the air temperature when heat is applied in a radiant system, the air flow when air is blown across the image in a convective system, and power level in a microwave system.

Figure 1:
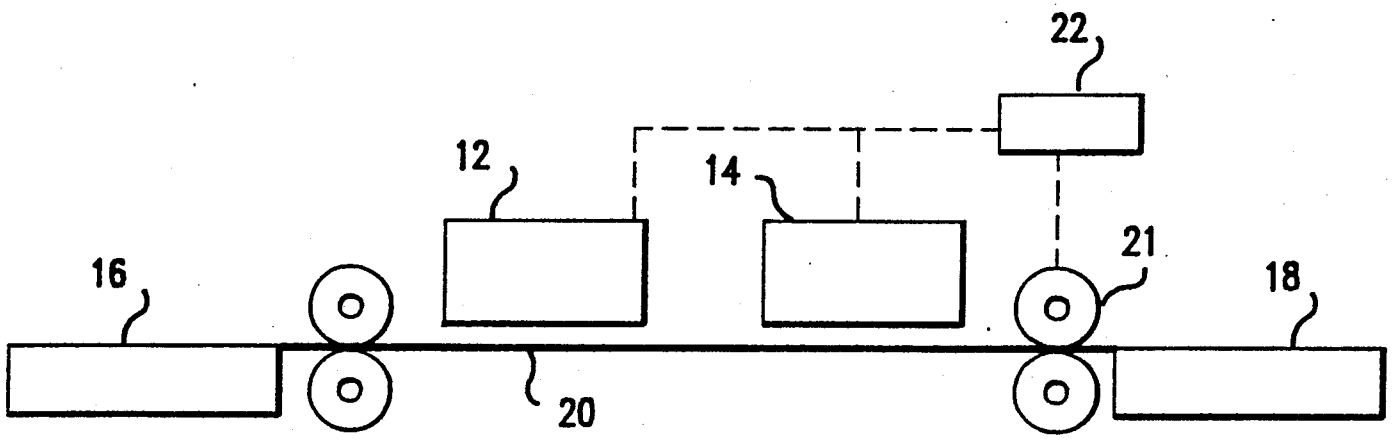
FIG. 1 is a schematic view showing a dryer and transport path of an image output terminal according to the present invention.

With reference to FIG. 1, the present invention can be described in schematic form as comprising an imaging station 12, an internal or external drying station 14, input and output trays 16 and 18, and a paper transport path 20 connecting the components and the input tray 16 through the imaging station 12 and the drying station 14, and finally to the output tray 18.

Information representing each page of images is digitally represented and is analyzed for determining a mass-area coverage of images on each page prior to a drying operation. After the page has been processed in the imaging station, a control means 22 determines the mass-area coverage of the image from information provided by the imaging station and sets control parameters for the drying station 14 based on the determined area coverage. The control parameters can be drying temperature, duration of drying time or transport speed through the drying station (via control of the rollers 21). Other parameters may be possible depending on the type of dryer. For example, power level can be a control parameter for a microwave dryer or blower speed can be a parameter for a convective dryer. Preferably, the control has default values which are set for minimal heating power requirements and maximum paper throughput while still providing adequate imaging for low area coverage jobs.

Figure 2:
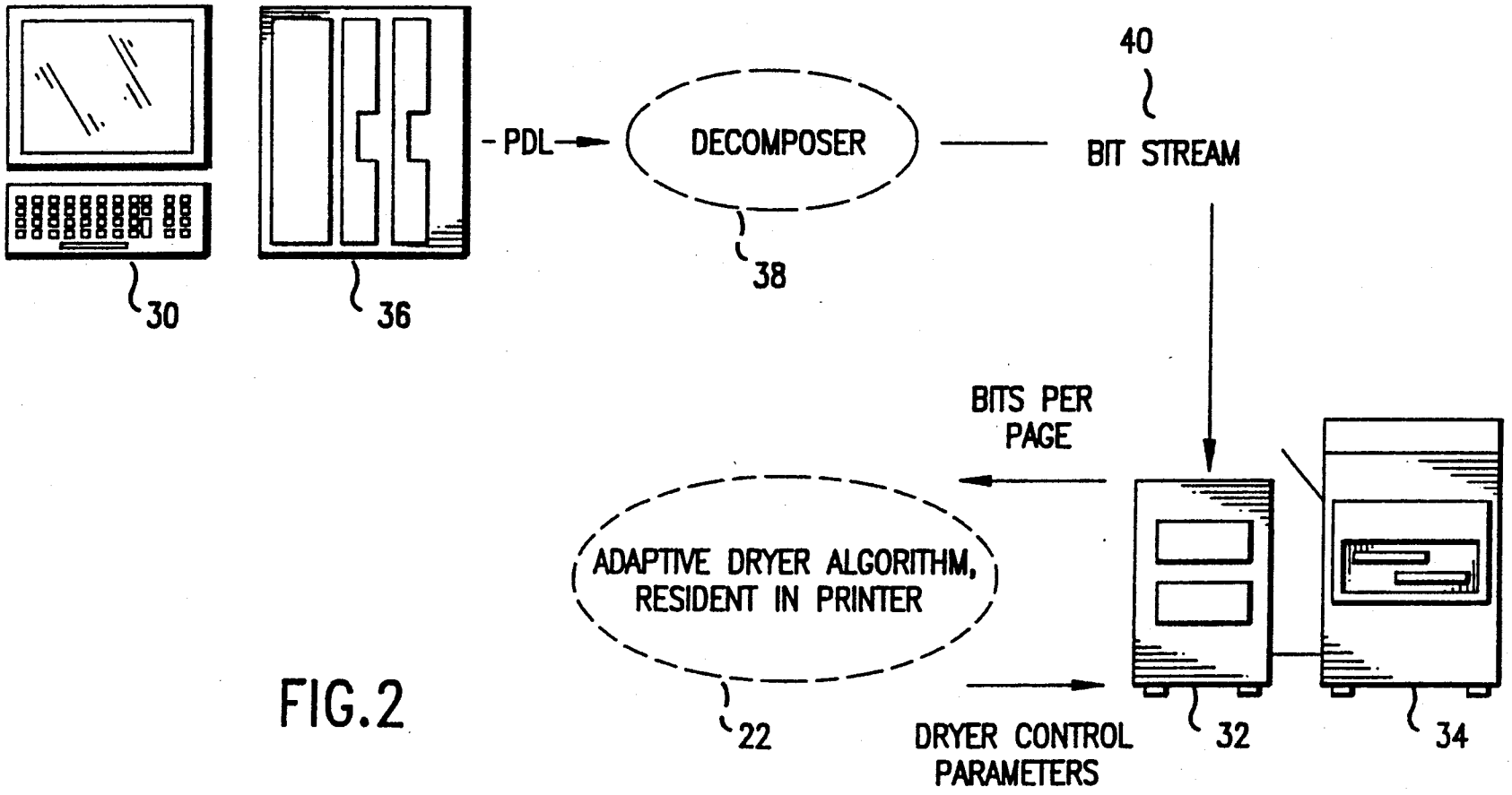
FIG. 2 is a flowchart of the data flow process of a workstation including a terminal, an electronic scanning substation and an image output terminal and how the data examined by a control algorithm can be used to determine drying time parameters.

Illustrated in FIG. 2 is a workstation to which an embodiment of the present invention is applied. FIG. 2 shows a personal computer (PC) 30 which has included therewith a CPU, a memory and input/output ports, the PC 30 being in electrical communication with an electronic scanning subsystem (ESS) 32 and an image output terminal (IOT) 34. The PC 30 corresponds to the imaging station 12 of FIG. 1 and ESS 32 and IOT 34 are part of a printer having therein the drying station 14. Information representing a desired page to be output is digitally stored in a page description language (PDL) in memory 36. A particular page or document of information can be output to the IOT 34 from the memory 36 by the following procedure. The information which is still encoded as PDL is sent to the ESS 32 through communication lines and is decomposed by a decomposer 38 which is located in intermediate hardware into a bit stream 40. Although this specific example utilizes the decomposer 38 in intermediate hardware, the decomposer 38 could equally be located in the PC 30, the ESS 32 or the IOT 34. The bit stream information is sent through the communication lines to the ESS 32 where the bit stream 40 is routed through the adaptive dryer control means 22 resident in the printer (IOT) 34 or the ESS 32 which can analyze the bit stream 40 and make a determination as to the complexity of a page, i.e., the area coverage of ink on the page and the mass of ink to be applied, by determining the bits per page that the bit stream 40 has allocated. The determination of the estimated mass-area coverage of ink on the page by bits per page comparison is used as a determining factor for calculation of drying requirements of that particular page. This value can be used is many ways.

According to one embodiment of the present invention, the IOT 34 could operate under predetermined dryer operating parameters, some of these parameters including a transport feed rate of a recording medium past a dryer station and/or the power output of the dryer station. These can be determinable to accommodate adequate fixing of an image onto the recording material for a high percentage of routine printing jobs. However, a certain threshold value of bits per page could be stored in memory to represent a bit per page value which is sufficiently higher than the routine printing jobs so as to cause an inadequate fixing of the image onto the recording material if the preset operating parameters were still used. If the bit per page determination value is higher than the threshold value, control means 22 could send a signal to the IOT 34 to change the operating parameters of the IOT 34 to a second set of values which would provide adequate fixing of the image onto a recording material such as paper. The second values may represent changes of one or more parameters such as the power output of the drying station or the feed rate of the recording material through the drying station, either of which will result in a greater amount of drying capacity. By being able to change the operating parameters of the drying station dependent on the amount of mass-area coverage of each page, reduction of power requirements are attainable which can lower machine operating costs.

According to another embodiment, a plurality of threshold values can be stored in memory, each corresponding to a different level of mass-area coverage, and each being associated with a certain set of operating parameters of the drying station by utilizing a look-up table. The look-up table includes values which can be used by the control means 22 to adjust the operating parameters of the drying station to various settings. By utilizing a plurality of settings, the drying requirements can be better adapted to closely set the drying station to operate at parameters which closely match the specific drying requirements of each page without underdrying or needlessly overdrying the recording material.

Figure 3:
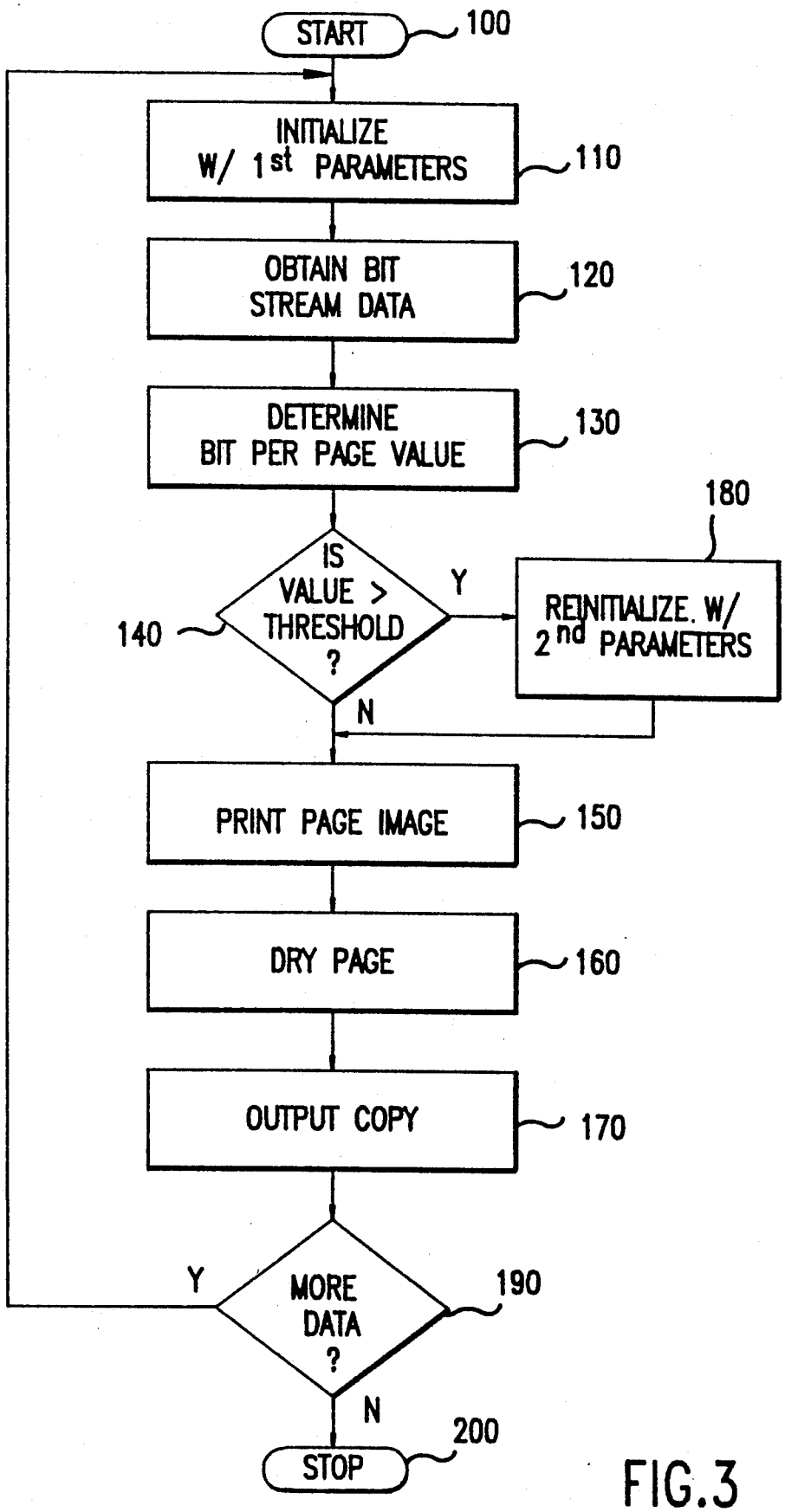
FIGS. 3–5 are various flowcharts depicting exemplary methods of obtaining operating parameters and controlling drying operations of a printer according to the present invention.

In operation, as shown in FIG. 3, the printer is controlled by the following program wherein a start operation 100 is performed by the program, followed by step 110 which initializes normal operating parameters for the printer. These parameters have been predetermined and are preferably set for minimal heater power requirements and maximum paper throughput. Bit stream information is obtained at step 120 from digital storage followed by step 130 which determines the number of bits per page of information from the bit stream. Since the data is digital, this number is easily obtainable. Further, the number of bits per page information can be readily translated into a percent area coverage and mass of ink. Step 140 checks to see if the value obtained in step 130 is greater than a predetermined threshold located in memory. If the value is less than the threshold then the program continues to step 150. If the value is greater than the threshold then the program jumps to step 180 which reinitializes operational parameters which control a paper drying operation. These parameters are changed to second parameters which can increase the amount of power output of the drying station which increases heat output and/or decrease transport feed speed of the page through the drying station either one of which will increase the drying intensity to which the ink is subjected. This last change results in longer exposure of the page to the drying station which permits more drying to occur without increasing the drying station output. After one or both of these parameters have been changed, the program continues with step 150 which obtains a paper from an input storage tray, transports the paper and prints a page of unfixed information (images) on the paper. Next, step 160 transports the unfixed image containing paper to the drying station which now is adequately set to fix the image on the paper. Step 170 outputs the fixed page to an output tray. Step 190 checks if more bit stream data is present. If there is more data then the program loops to step 110, otherwise the printing operation is stopped.

Figure 4:
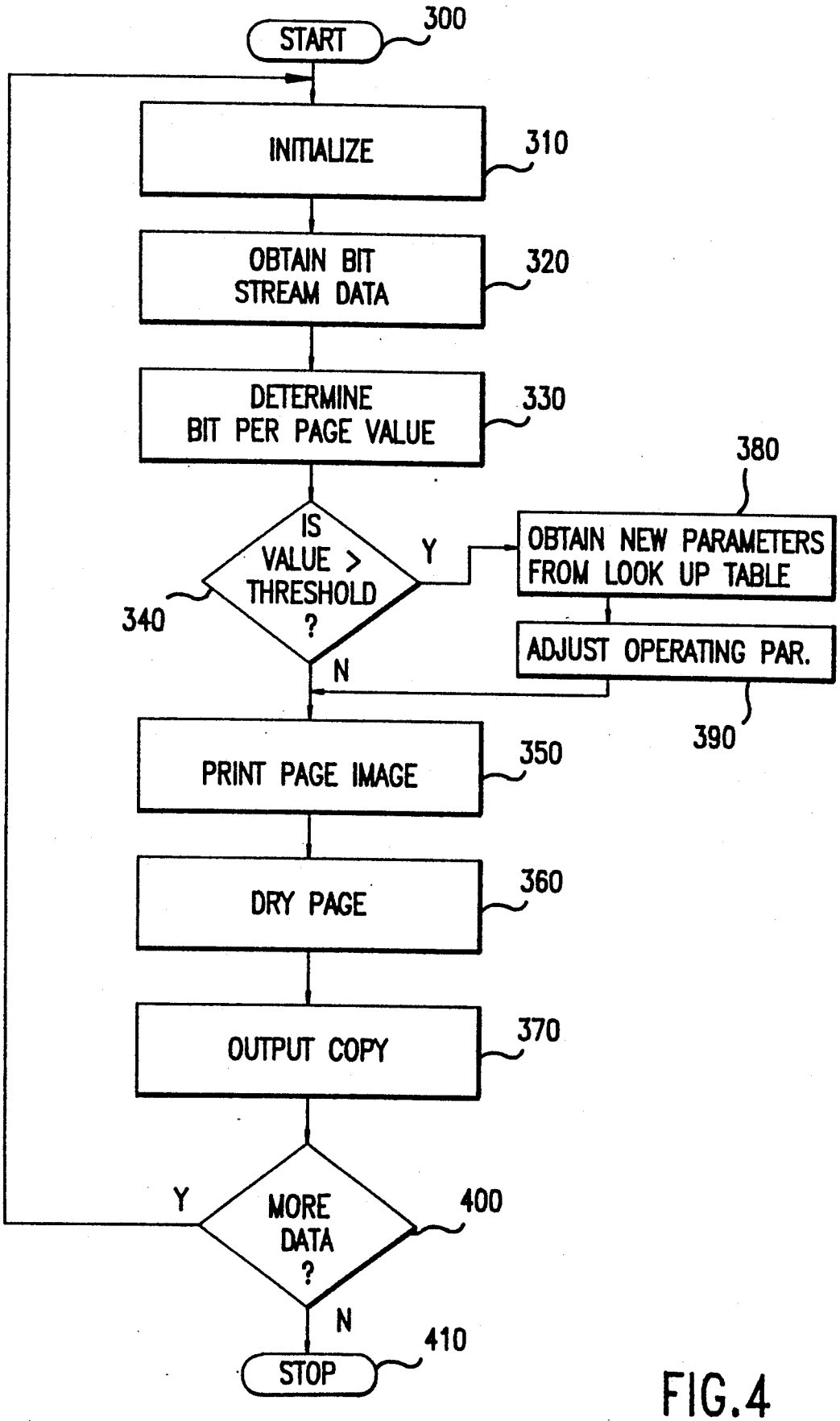

FIG. 4 shows a flow chart of another embodiment in which a start operation 300 is performed, followed by step 310 which initializes normal operating parameters for the printer. Bit stream information is obtained at step 320 followed by step 330 which determines the number of bits per page of information from the bit stream. Step 340 checks the bit stream value against a minimum threshold value. If the threshold is not exceeded, then the program continues with step 350. If the threshold is exceeded then step 380 determines new operational parameters based on look-up table values determined from the bit stream value. Step 390 then adjusts drying station operational parameters based on the look-up table values and then jumps to step 350. Step 350 obtains a paper from an input paper tray, transports the paper and prints a page of unfixed information (images) on the paper. Next, step 360 transports the unfixed image containing paper to the drying station which now is set to adequately fix the image on the page followed by step 370 which outputs the fixed page to an output tray. Step 400 checks if more bit stream data is present. If there is more bit stream data, then the program loops to step 310, otherwise the printing operation is stopped.

Figure 5:
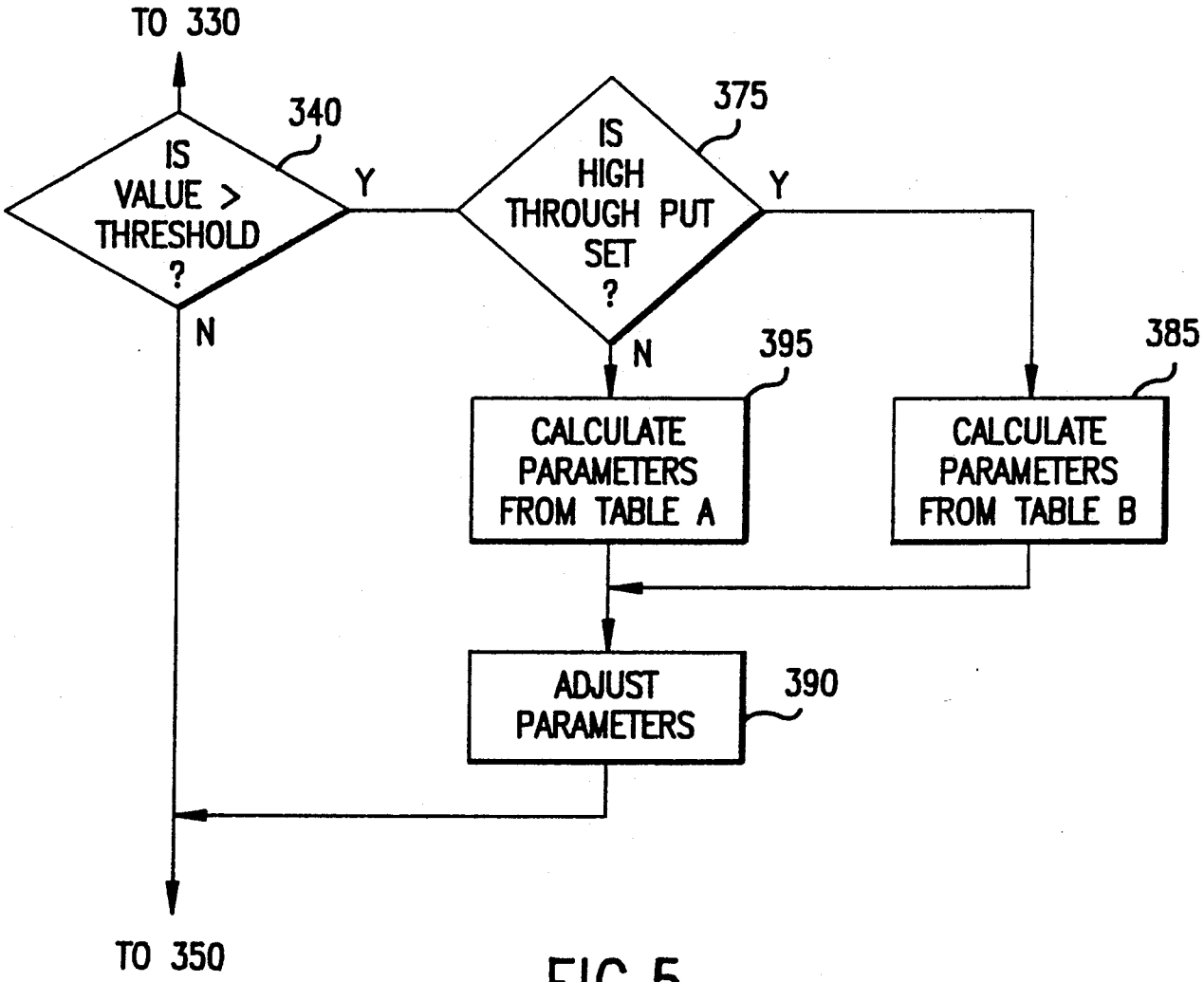

A variant of this FIG. 4 embodiment is shown in FIG. 5 in which the printer is provided with a selection means which can select either a high throughput mode or a normal mode. The modified program includes step 375 which checks which mode has been selected. If the high throughput mode is set then the program calculates operational parameters from a high throughput look-up table based on the bit stream value. If the normal mode is selected, the program calculates operational parameters from a normal mode look-up table based on the bit stream value. The high throughput look-up table comprises variables which modify the operational parameters of the drying station temperature and substantially leave transport feed speed at a preselected high rate. If the normal mode is selected, the normal mode look-up table comprises values which modify the operational parameters of the transport feed speed to slow the transport speed down, while substantially leaving the drying station temperature at a preselected minimum value.

The image printed on the sheet can be typical text image (usually having about 6% mass-area image coverage) or dense, solid image such as pictorials (usually having about a 50% mass-area image coverage). The drying parameters can be set at levels corresponding to typical text images or pictorial images, the level corresponding to pictorial images requiring greater drying intensity.

The invention has been described with reference to the preferred embodiments thereof, which are illustrative and not limiting. Various changes may be made without departing from the spirit and scope of the invention as defined in the appended claims.

What is claimed is:

1. A method of fixing a printing substance previously placed on a sheet to the sheet, comprising the steps of:
   determining a percentage of a sheet area of the sheet which is covered by the printing substance;
   moving the sheet at a feed speed past a dryer operating at a fixing temperature;
   selecting either a high speed or normal speed throughput mode for the sheet; and
   variably controlling at lest one of the feed speed and the fixing temperature based on the determined percentage and whether the high speed or normal speed throughput mode is selected.

2. The method of claim 1, further comprising the step of determining a mass of the printing substance to be applied to the sheet, and variably controlling at least one of the feed speed and fixing temperature based on the determined mass.

3. The method of claim 1, wherein said fixing temperature is maintained substantially constant, and said feed speed is varied based on the determined percentage.

4. The method of claim 1, wherein said feed speed is controlled by selecting the feed speed from a look-up table which correlates a plurality of feed speeds to a plurality of printing substance sheet area coverages.

5. The method of claim 1, wherein said printing substance is liquid ink placed on the sheet by a drop-on-demand printhead.

6. A method of fixing a printing substance previously placed on a sheet to the sheet, comprising the steps of:
   determining whether the printing substance was placed on the sheet in the form of pictorials or text;
   moving the sheet at a feed speed past a dryer operating at a fixing temperature;
   variable controlling one of a feed speed and fixing temperature to be at first levels corresponding to the printing substance being placed on the sheet in the form of text, unless the printing substance is determined to be placed on the sheet in the form of pictorials, in which case the feed speed and fixing temperature are controlled to be at second levels.

7. The method of claim 6, further comprising the steps of:
   determining a mass coverage and percentage of sheet area coverage of the printing substance applied to the sheet;
   wherein said controlling step includes variably controlling of the feed speed and fixing temperature based on the determined mass and percentage sheet area coverage.

8. The method of claim 6, wherein the fixing temperature is equal at said first level and said second level, and the feeding speed at said first level is faster than the feeding speed at the second level.

9. A method of fixing a printing substance previously placed on a sheet to the sheet, comprising the steps of:
   determining a mass of the printing substance to be applied to the sheet;
   moving the sheet at a feed speed past a dryer operating at a fixing temperature; and
   variably controlling at least one of the feed speed and fixing temperature based on the determined mass.

10. The method of claim 9, further comprising the steps of determining a percentage of a sheet area of the sheet which is to be covered by the printing substance, and variably controlling at least one of the feed speed and fixing temperature based on the determined percentage.

11. A method of fixing a printing substance previously placed on a sheet to the sheet, comprising the steps of:
   determining a mass-area coverage of the printing substance to be applied to the sheet;
   moving the sheet at a feed speed past a dryer operating at a fixing temperature; and
   variably controlling at least one of the feed speed and fixing temperature based on the determined mass-area coverage.

12. A printer for forming images on a recording medium comprising:
   means for placing a printing substance on the recording medium according to information relating to the images to be formed on the recording medium;
   wherein said means for placing a printing substance on the recording medium is a multi-color ink jet printhead which places a drop of a first color ink on top of a drop of a second color to form a third color thereby increasing a mass of printing substance applied to the record medium without increasing a percentage of coverage area;
   a drying unit for fixing the printing substance on the recording medium, said drying unit including fixing means for fixing the printing substance on the recording medium at a fixing temperature, and feeding means for feeding the recording medium past said fixing means at a feed speed;
   means for determining a mass of a printing substance applied on the recording medium; and
   control means for variably controlling at least one of the fixing means and the feeding means based on the determined mass so that at least one of the fixing temperature and feed speed is varied in response to varying mass coverage of the printing substance.

13. The printer of claim 12, further comprising means for determining a percentage of area of the recording medium which is covered by the printing substance, and wherein the control means variably controls at least one of the fixing means and the feed means based on the determined percentage of area coverage so that at least one of the fixing temperature and feed speed is varied in response to varying percentage of area coverage of printing substance applied to the recording medium.

14. The printer of claim 12, wherein said control means controls said drying unit so that said fixing means operates at a substantially constant fixing temperature, and said feeding means operates at a feed speed which is varied based on the determined percentage.

15. The printer of claim 12, wherein said control means controls said feed speed by selecting the feed speed from a look-up table which correlates a plurality of feed speeds to a plurality of printing substance sheet area coverages.

16. The printer of claim 12, wherein said printing substance is liquid ink, and said means for placing a printing substance on the recording medium is a drop-on-demand printhead.

17. The printer of claim 12, wherein said means for determining determines whether the printing substance was placed in the recording medium in the form of pictorials or text.

18. The printer of claim 17, wherein said feeding means and said fixing means are controlled to be at first levels corresponding to the printing substance being placed on the recording medium in the form of text, unless the printing substance is determined to be placed on the recording medium in the form of pictorials in which case the feeding means and the fixing means are controlled to be at second levels.

19. The printer of claim 12, wherein said information relating to the images to be formed comprises the number of bits per image.

20. A dryer for fixing a printing substance previously formed on a substrate to the substrate, comprising:

means for determining a mass and percentage of substrate area coverage of the printing substance to be applied to the substrate as a function of a percentage of a recording medium area of the substrate which contains the printing substance and a mass of the printing substance;

drying means for fixing the printing substance on the substrate at a fixing temperature;

feeding means for moving the substrate through the drying means at a feed speed;

selecting means for selecting a high speed or normal speed sheet throughput mode;

control means for variably controlling at least one of the fixing temperature and feed speed for fixing of the printing substance based on said determined mass and percentage of substrate area coverage of the printing substance and on whether a high speed or normal speed sheet throughput mode is selected.

21. The dryer of claim 20, wherein the drying means applies heat to the substrate and the control means controls the amount of heat.

22. The dryer of claim 20, wherein the feeding means has a variable feed speed, and the control means controls the variable feed speed.

* * * * *